US010405085B2

(12) United States Patent
Tiefenau et al.

(10) Patent No.: US 10,405,085 B2
(45) Date of Patent: Sep. 3, 2019

(54) RECEIVER ASSEMBLY

(71) Applicant: Sonion Nederland B.V., Hoofddorp (NL)

(72) Inventors: Andreas Tiefenau, Hoofddorp (NL); Laurens de Ruijter, Hoofddorp (NL); Oleg Antoniuk, Hoofddorp (NL); Nicolaas Maria Jozef Stoffels, Hoofddorp (NL); Umut Tabak, Hoofddorp (NL); Johannes de Jonge, Hoofddorp (NL); Rasmus Voss, Hoofddorp (NL); Caspar Titus Bolsman, Hoofddorp (NL); Arno W. Koenderink, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/843,709

(22) Filed: Dec. 15, 2017

(65) Prior Publication Data

US 2018/0176676 A1 Jun. 21, 2018

(30) Foreign Application Priority Data

Dec. 16, 2016 (EP) ..... 16204741

(51) Int. Cl.

*H04R 1/28* (2006.01)
*H04R 1/02* (2006.01)
*H04R 25/00* (2006.01)

(52) U.S. Cl.

CPC ..... *H04R 1/288* (2013.01); *H04R 1/025* (2013.01); *H04R 1/2857* (2013.01); *H04R 25/456* (2013.01); *H04R 25/604* (2013.01)

(58) Field of Classification Search

CPC .. H04R 2499/11; H04R 25/604; H04R 1/025; H04R 1/2857; H04R 1/288; H04R 25/456; H04R 1/1016; H04R 1/2876

(Continued)

(56) References Cited

U.S. PATENT DOCUMENTS 3,019,306 A 1/1962 Weiss
3,257,516 A * 6/1966 Knowles ..... H04R 25/604 381/345

(Continued)

FOREIGN PATENT DOCUMENTS

EP 1248496 A2 10/2002
EP 1353531 A2 10/2003

(Continued)

OTHER PUBLICATIONS

Extended European Search Report in European Patent Application No. 16204741.9, dated Jun. 22, 2017 (4 pages).

(Continued)

*Primary Examiner* — Yogeshkumar Patel
(74) *Attorney, Agent, or Firm* — Nixon Peabody LLP

(57) ABSTRACT

The present invention provides a receiver assembly comprising a receiver and an assembly housing. The receiver comprises a sound outlet configured to outlet sound from the receiver. The receiver is arranged at least partly within the assembly housing. The assembly housing comprises an assembly sound outlet. The sound outlet is arranged in communication with the assembly sound outlet for outlet of sound from the receiver via the assembly sound outlet. A vibration dampening element connects the sound outlet and the assembly sound outlet. The vibration dampening element is formed by an elastic foil and is compliant to reduce vibrations from the receiver to the assembly housing.

20 Claims, 8 Drawing Sheets

(58) Field of Classification Search
USPC ..... 381/368, 354, 162, 338, 353, 355, 322
See application file for complete search history.

(56) References Cited

U.S. PATENT DOCUMENTS

| | | | |
|---|---|---|---|
| 6,459,800 | B1 | 10/2002 | Brimhall |
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 2003/0185412 | A1 | 10/2003 | Gebert |
| 2009/0016553 | A1 | 1/2009 | Ho |
| 2009/0161897 | A1 | 6/2009 | Fickweiler |
| 2011/0182453 | A1 | 7/2011 | van Hal |
| 2011/0189880 | A1 | 8/2011 | Bondo |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | van Halteren |
| 2013/0195295 | A1 | 8/2013 | van Halteren |
| 2015/0110328 | A1* | 4/2015 | Sondergaard ..... H04R 1/02 381/354 |

FOREIGN PATENT DOCUMENTS

| | | | | |
|---|---|---|---|---|
| EP | 2073572 | A1 | 6/2009 | |
| EP | 3051841 | A1 | 8/2016 | |
| GB | 2096863 | A | 10/1982 | |
| WO | WO-01-43498 | A1 * | 6/2001 | ..... H04R 25/604 |
| WO | WO 01/43498 | A1 | 6/2001 | |
| WO | WO 02/05592 | A2 | 1/2002 | |
| WO | WO 2004/008803 | A1 | 1/2004 | |
| WO | WO 2004/049757 | A1 | 6/2004 | |
| WO | WO 2007/038897 | A2 | 4/2007 | |
| WO | WO 2012/062761 | A1 | 5/2012 | |

OTHER PUBLICATIONS

Extended European Search Report in European Patent Application No. 17207709.1, dated May 4, 2018 (3 pages).
Extended European Search Report in European Patent Application No. 17207713.3, dated May 4, 2018 (4 pages).

* cited by examiner

RECEIVER ASSEMBLY

CROSS-REFERENCE TO RELATED APPLICATIONS

This application claims the benefit of European Patent Application Serial No. 16204741.9, filed Dec. 16, 2016, which is incorporated herein by reference in its entirety.

FIELD OF THE INVENTION

The present invention relates to a receiver assembly comprising a receiver and an assembly housing. The receiver assembly comprises a vibration dampening element to reduce vibrations from the receiver to the assembly housing.

BACKGROUND OF THE INVENTION

When producing sound, a receiver also creates vibrations. Such vibrations are unwanted and may put a limit on the performance of a personal audio device, such as a hearing aid. This is due to the fact that the vibrations can be picked up by the microphone and amplified again; i.e. feedback.

Prior art document EP 1 353 531 discloses a coil and a magnet assembly mounted on a printed circuit board (PCB). The PCB may be supported by the case. The use of the PCB provides a relatively rigid planar surface allowing precise positioning of the coil and magnet assembly.

EP 3 051 841 discloses a motor assembly attached to the receiver housing by a movable suspension structure to provide an internal balancing within the receiver itself.

Prior art documents WO 01/43498, EP 2 073 572, and US 2015/110328 disclose different suspension members, all being solid; i.e. with a significant material thickness of the wall defining the suspension members compared to the size of the suspension members. These suspension members thereby only provide limited reduction of vibrations from the receiver to the assembly housing.

SUMMARY OF INVENTION

It is an object of embodiments of the invention to provide an improved receiver assembly.

It is a further object of embodiments of the invention to provide a receiver assembly where vibrations from the receiver to the assembly housing can be reduced.

According to a first aspect, the invention provides a receiver assembly comprising a receiver and an assembly housing;

the receiver comprising a sound outlet configured to outlet sound from the receiver and being arranged at least partly within the assembly housing, the assembly housing comprising an assembly sound outlet, wherein the sound outlet is arranged in communication with the assembly sound outlet for outlet of sound from the receiver via the assembly sound outlet, and wherein a vibration dampening element connects the sound outlet and the assembly sound outlet, the vibration dampening element being formed by an elastic foil and being compliant to reduce vibrations from the receiver to the assembly housing.

The receiver may be adapted to form part of any personal audio device, such as a hearing aid, such as a Behind-the-Ear (BTE) device, an In the Ear (ITE) device, a Receiver in the Canal (MC) device, or any other personal audio device, such as headphones, earphones, and other earpieces. In the context of the present invention, the term "hearing aid" shall be understood as an electromagnetic device which is adapted to amplify and modulate sound and to output this sound to a user, such as into the ear canal of a user.

However, it should further be understood, that the receiver in one embodiment may be a balanced armature receiver, whereas the receiver in other embodiments may also comprise other transducer technologies, such as e.g. piezo technology, moving coil, electrostatic receiver technologies, and microphones, such as electret, MEMS, etc.

Thus, the receiver may be adapted to receive an electrical signal and output a corresponding audio signal through the sound outlet.

It should further be understood, that the assembly may comprise more than one receiver, such as two, three, or more receivers. Assemblies comprising more than one receiver may as an example comprise receivers of a single type, such as two balanced armature receivers, or may alternatively comprise receivers of different types, such as a balanced armature receiver and an electrostatic receiver.

The receiver may comprise a magnet assembly and an armature. The magnet assembly may be arranged to provide a magnetic field in an air gap, and the armature may comprise at least one leg which extends through the air gap.

The armature may be made from any type of material, element and/or assembly able to guide or carry a magnetic flux. The armature may be electrically conducting or not.

The receiver may further comprise a diaphragm which is operationally attached to the armature, such that movement of the armature is transferred to the diaphragm. It will be appreciated that movement of the diaphragm causes sound waves to be generated. In one embodiment, the diaphragm is operationally attached to the armature by means of a diaphragm connecting member, such as a drive pin. Alternatively, the diaphragm may itself be attached to the armature.

The diaphragm may comprise a plastic material, such as a polymer, or alternatively a metal material such as aluminium, nickel, stainless steel, or any other similar material. It should however be understood, that the diaphragm may comprise a plurality of materials. The diaphragm may divide the chamber into two chambers, such as a front volume and a back volume.

The assembly housing may be located in a shell made of a soft material, such as silicone, thereby improving the comfort. To improve comfort further, an individual shell may be made for each user to fit the ear of the user.

The receiver may be formed as a substantially box-shaped element. Other shaped may however also be applicable.

The assembly housing may likewise be formed as a substantially box-shaped element. However, other shapes may also be applicable, such as shapes which fit the ear of a user.

The receiver is arranged at least partly within the assembly housing. Thus, the receiver may have an outer surface facing toward an inner surface of the assembly housing. The inner and outer surfaces may each comprise a first surface, a second surface, a third surface, and even more surface. As an example, a substantially box-shaped receiver may comprise six outer surfaces.

If the receiver and/or assembly housing is substantially box-shaped it should be understood, that the edges and corners may be rounded off. This may also be the case for receivers and assembly housings in other shapes.

The sound outlet of the receiver is arranged in communication with the assembly outlet for outlet of sound from the receiver via the assembly sound outlet. By arranging the sound outlet in communication with the assembly outlet, vibrations from the receiver may be transferred to the assembly housing.

To reduce the risk of transferring such vibrations, a vibration dampening element connects the sound outlet and the assembly sound outlet. The vibration dampening element is compliant to enable reduction of vibrations. The vibration dampening element is formed by an elastic foil. This is in contradiction to traditional injection moulded sound channels of rubber (silicone) which do not offer the same compliance.

In one embodiment, the vibration dampening element is compliant in at least two directions.

In the context of the present invention, the term "dampen vibration" should be understood as reducing vibration by decoupling the receiver from the assembly housing. It should be understood, that some vibration may still be present.

In the context of the present invention, the term "connects" not only covers embodiments where the vibration dampening element is in contact with the receiver and the assembly housing. The vibration dampening element may also connect the sound outlet and the assembly sound outlet by being in contact with the receiver and the assembly housing by an additional element.

The vibration dampening element may be more compliant in the direction of the sound outlet that in directions transverse to the sound outlet. This may be particularly interesting for receivers which primarily produce vibrations in the direction of the sound outlet, such as a dual receiver. However, it should understood, that the dampening element may in an alternative embodiment be equally compliant in at least two directions.

The vibration dampening element may comprise at least one through hole allowing sound to propagate through the vibration dampening element.

To more effectively decouple the vibrations, the receiver may be movably arranged in the assembly housing, e.g. by suspending the receiver in the assembly housing by use of a suspension structure.

The vibration dampening element may seal a passage between the sound outlet and the assembly sound outlet in order to facilitate outlet of sound from the receiver via the assembly outlet, and to prevent sound propagation in a space between an outer surface of the receiver and in inner surface of the assembly housing.

In one embodiment this may be achieved by arranging the vibration dampening element so that it seals a passage between an outer surface of one sound outlet and the assembly sound outlet and an inner surface of the other one of the sound outlet and the assembly sound outlet.

In one example, the sound outlet and the assembly sound outlet are provided as two elongated sound channels. The diameter of one of these sound channels may be smaller than the diameter of the other one of the sound channel to facilitate insertion of one sound channel at least partly into the other sound channel. In this embodiment the vibration dampening element may be arranged circumferential around the smaller sound channel and circumferential along the inner surface of the other sound channel, thereby sealing the passage between the two sound outlets.

It should be understood that the sound outlet, the assembly sound outlet, and the sound channels may have a circular cross-section. However, other cross-sectional shapes may also be applied. As an example, the cross-section may be oval or rectangular, or of any other arbitrary shape.

In an alternative embodiment, the vibration dampening element forms a sound channel from the sound outlet to the assembly sound outlet. In this embodiment the vibration dampening element may be attached directly to the receiver and to the assembly housing. It should however be understood, that the vibration dampening element may be attached to at least one of the receiver and the assembly housing by one or more connecting element, e.g. to facilitate connection hereof.

The vibration dampening element is made of a foil, such as a thin rubbery foil to achieve a sufficient compliance.

The vibration dampening element may be made in one piece. Furthermore, the vibration dampening element may be made of one single material.

The vibration dampening element may as an example be formed by a polymer material or by a metal, or combinations hereof.

By using a foil material, the vibration dampening element may be made by thermoforming processes. The foil material may be rubbery TPU (Thermoplastic polyurethane), PU (Polyurethane), PET (Polyethylene terephthalate), PEEK (Polyether ether ketone), and similar materials.

The foil may have a material thickness in the range of 4-40 microns to increase the flexibility of the vibration dampening element.

The vibration dampening element may be attached to the receiver and/or the assembly housing by use of different processes, such as laminating, adhesively, ultrasonic welding, clamping, etc.

To facilitate attachment of the vibration dampening element to the receiver and the assembly housing, the vibration dampening element may form a first attachment plane in which it can be attached to the receiver and may form a second attachment plane in which it can be attached to the assembly housing. The first and second attachment planes may be off-set relative to each other, whereby the vibration dampening element extends in a direction transverse to the first and second attachment planes.

The first and second attachment planes may be parallel to each other.

The vibration dampening element may have an arc-shaped cross-section in a plane being perpendicular to the attachment planes. The arc-shaped cross-section may increase the efficiency of the vibration dampening element, as decoupling may be facilitated. It should be understood, that the vibration dampening element may form more than one arc-shaped cross-section, thereby forming a wave-shape in at least one cross-section.

It should however be understood, that as an alternative to an arc-shaped cross-section, the vibration dampening element may have a square-shaped or trapezoid cross-section in a plane being perpendicular to the attachment planes. These cross-sections may also increase the efficiency of the vibration dampening element.

It should be understood, that the vibration dampening element may be formed as a substantially flat element, thereby extending parallel to the sound outlet. This embodiment may be of particular interest in embodiments where at least one of the sound outlet and the assembly outlet is provided as an elongated sound channel. It should however be understood, that the vibration dampening element may also have an arc-shaped cross-section in these embodiments.

In one embodiment, the receiver may comprise an additional sound outlet, and the assembly housing may comprise an additional assembly sound outlet, where the additional sound outlet is arranged in communication with the additional assembly sound outlet for outlet of sound from the receiver via the additional assembly sound outlet. In this embodiment, an additional vibration dampening element being compliant may connect the additional sound outlet and the additional assembly sound outlet to reduce vibrations from the receiver to the assembly housing. The receiver may be a module of two receivers or a dual receiver with two sound outlets.

It should be understood, that the receiver may be traditional dual receiver with a common sound outlet, where the common sound outlet of the dual receiver forms the sound outlet.

The receiver assembly may comprise at least one stiffening member which may be more rigid than the vibration dampening element and which may connect the vibration dampening element to at least one of the receiver and the assembly housing. By providing a stiffening member with a compliance being lower than the compliance of the vibration dampening element, connection of the vibration dampening element to the receiver and/or to the assembly housing may be facilitated.

The receiver assembly may further comprise an air path way configured to guide air away from the receiver to reduce pressure induced vibrations. The air path way may constitute an airtight path from the receiver to the outside of the assembly housing while at the same time not interfering with the decoupling of the receiver from the assembly housing.

The vibration dampening element may be adhesively attached to at least one of the receiver and the assembly housing. Alternatively, the vibration dampening element may be welded to at least one of the receiver and the assembly housing, e.g. by use of ultrasonic welding. As a further alternative, the vibration dampening element may be clamped or laminated to at least one of the receiver and the assembly housing. It should be understood, that the way of attachment may be by use of one method to the receiver and may be by an alternative method to the assembly housing.

As the receiver assembly may be exposed to mechanical shocks, e.g. if dropped on the floor, it may be an advantage if the receiver assembly further comprises a shock protection element arranged in the assembly housing, as this may protect the receiver from impact from the assembly housing. The shock protection element may have a higher compliance than the vibration dampening element.

To ensure sufficient efficiency, the shock protection element may be made of a soft material such as a foam. The shock protection effect may be achieved by a combination of the physical properties and the dimensions of the shock protection element. As an example, a shock protection element in the form of a foam with micro pores provided at a thickness of 0.4 mm may provide the same shock protection as a shock protection element of latex; i.e. a polymer, provided at a thickness of 0.25 mm, since these shock protection elements have the same mechanical stiffness due to the combination of their mechanical properties and dimensions.

It should be understood that other materials and/or thicknesses and/or combinations of materials and/or thicknesses may also be possible.

The shock protection element may be attached to at least one of an outer surface of the receiver and an inner surface of the assembly housing. The shock protection element may only be in contact with one of the receiver and the assembly housing. However, during a mechanical shock it may touch both the receiver and the assembly housing to thereby lower the impact of a shock.

It should be understood, that the receiver assembly may comprise a plurality of shock protection elements. As an example, a shock protection element may be arranged on each side of the receiver to protect the receiver from impact on each side.

In one embodiment, the receiver assembly may further comprise an additional receiver comprising an additional sound outlet and a joiner. The joiner may comprise a spout portion forming at least one sound channel extending through the spout portion and a mounting plate portion having a first surface and an opposite second surface. The mounting plate portion may comprise first engagement means for engaging the receiver at the first surface, and second engagement means for engaging the additional receiver at the second surface. When arranging the receiver and the additional receiver on opposite sides of the mounting plate portion, the sound outlet and the additional sound outlet can be aligned with one of the at least one sound channels extending through the spout portion. The vibration dampening element may connect the sound outlet and the additional sound outlet to the assembly sound outlet via the spout portion.

By use of a joiner assembling, positioning and alignment of the receiver and the additional receiver may be facilitated and may in some embodiments even be carried out without the use of additional fixture elements.

According to a second aspect, the invention provides a personal audio device comprising a receiver assembly according to the first aspect of the invention, wherein the receiver is configured to generate sound whereby it vibrates within a frequency range of 10 Hz-20 kHz, and wherein the vibration dampening elements is configured to elastically deform to thereby reduce transmission of vibration to the assembly housing.

The frequency range may depend on the type of personal audio device in which the receiver is used.

It should be understood, that a skilled person would readily recognise that any feature described in combination with the first aspect of the invention could also be combined with the second aspect of the invention, and vice versa.

The receiver assembly according to the first aspect of the invention is very suitable for the personal audio device according to the second aspect of the invention. The remarks set forth above in relation to the receiver assembly are therefore equally applicable in relation to the personal audio device.

BRIEF DESCRIPTION OF THE DRAWINGS

Embodiments of the invention will now be further described with reference to the drawings, in which.

DETAILED DESCRIPTION OF THE INVENTION

It should be understood that the detailed description and specific examples, while indicating embodiments of the invention, are given by way of illustration only, since various changes and modifications within the spirit and scope of the invention will become apparent to those skilled in the art from this detailed description.

Figure 1:
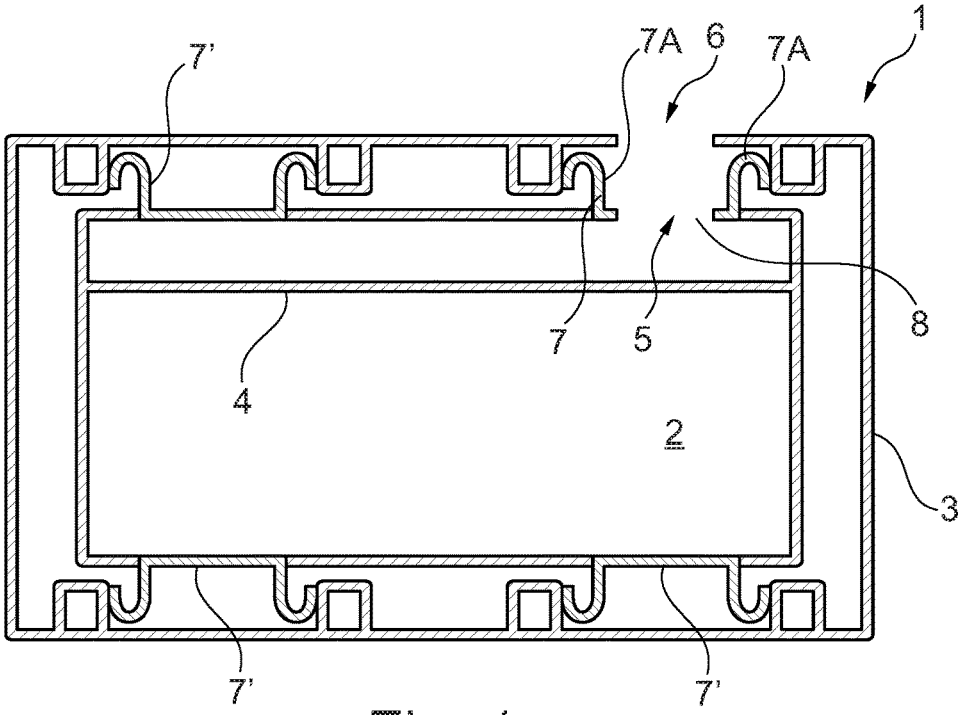
FIG. 1 schematically illustrates a receiver assembly according to the invention, FIG. 2 schematically illustrates an alternative embodiment of a receiver assembly according to the invention.

FIG. 1 schematically illustrates a receiver assembly 1 according to the invention. The receiver assembly 1 comprises a receiver 2 and an assembly housing 3.

The receiver 2 comprises a magnet assembly (not shown), an armature (not shown), a diaphragm 4 being operationally attached to the armature, and a sound outlet 5 configured to outlet sound from the receiver 2. It should be understood, that other types of receivers are equally applicable for the invention.

The receiver 1 is arranged within the assembly housing 3 comprising an assembly sound outlet 6.

The sound outlet 5 is arranged in communication with the assembly sound outlet 6 for outlet of sound from the receiver 2 via the assembly sound outlet 6.

A vibration dampening element 7 connects the sound outlet 5 and the assembly sound outlet 6 and is compliant to reduce vibrations from the receiver 2 to the assembly housing 3. In the illustrated embodiment, the vibration dampening element 7 has an arc-shaped cross-section 7A along the circumference of the sound outlet and the assembly sound outlet.

The vibration dampening element 7 comprises a through hole 8 allowing sound to propagate through the vibration dampening element.

Additionally, three suspension elements 7' are arranged in the assembly housing 3 and connect the receiver 2 and the assembly housing 3. The suspension elements 7' are similar to the vibration dampening element 7, however without a through hole. Due to the compliance of the suspension element 7', the receiver 2 is movable arranged in the assembly housing 3.

Figure 2:
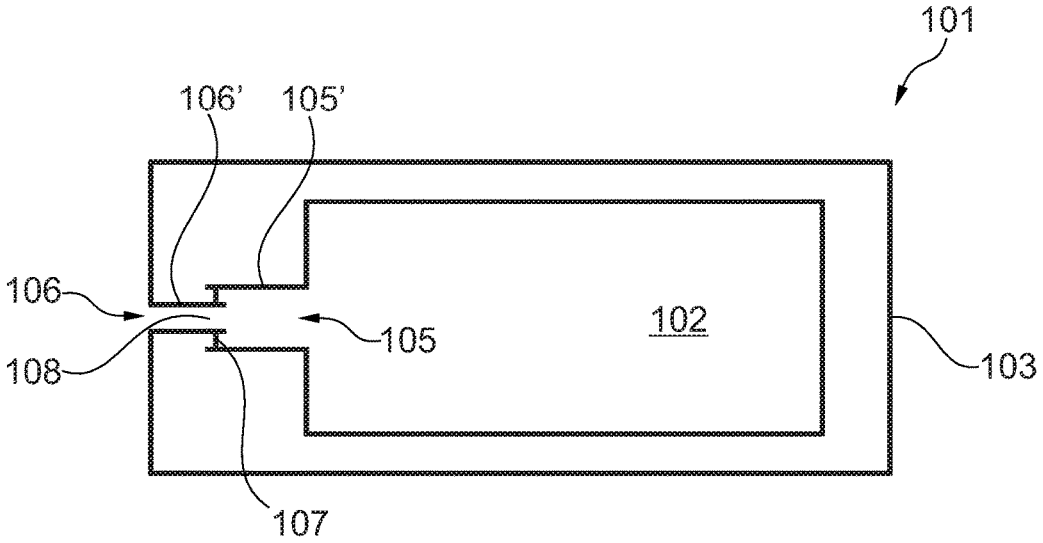

FIG. 2 schematically illustrates an alternative embodiment of a receiver assembly 101 according to the invention. The receiver assembly 101 comprises a receiver 102 and an assembly housing 103.

The receiver 102 comprises a sound outlet 105 configured to outlet sound from the receiver 102. The receiver 102 is arranged within the assembly housing 103 comprising an assembly sound outlet 106.

The sound outlet 105 is arranged in communication with the assembly sound outlet 106 for outlet of sound from the receiver 102 via the assembly sound outlet 106.

A vibration dampening element 107 connects the sound outlet 105 and the assembly sound outlet 106 and is compliant to reduce vibrations from the receiver 102 to the assembly housing 103.

In the illustrated embodiment, the sound outlet 105 and the assembly sound outlet 106 are provided as two elongated sound channels 105', 106'. The diameter of assembly sound channel 106' is smaller than the diameter of the sound channel 105 to facilitate partly insertion of the assembly sound channel 106' into the sound channel 105'. The vibration dampening element 107 is formed as a substantially flat element extending parallel to the sound outlet 105 and the assembly sound outlet 106 and is arranged circumferential around the assembly sound channel 106' and circumferential along the inner surface of the sound channel 105', thereby sealing the passage between the two sound outlets 105, 106.

It should be understood, that the diameter of assembly sound channel 106' in an alternative embodiment could be equal to the diameter of the sound channel 105' as the vibration dampening element may be arranged at an end portion of each of the sound channel 105' and the assembly sound channel 106' which may be arranged end to end with a vibration dampening element in between.

The vibration dampening element 107 comprises a through hole 108 through which the assembly sound channel extends 106' thereby allowing sound to propagate through the vibration dampening element.

Figure 3:
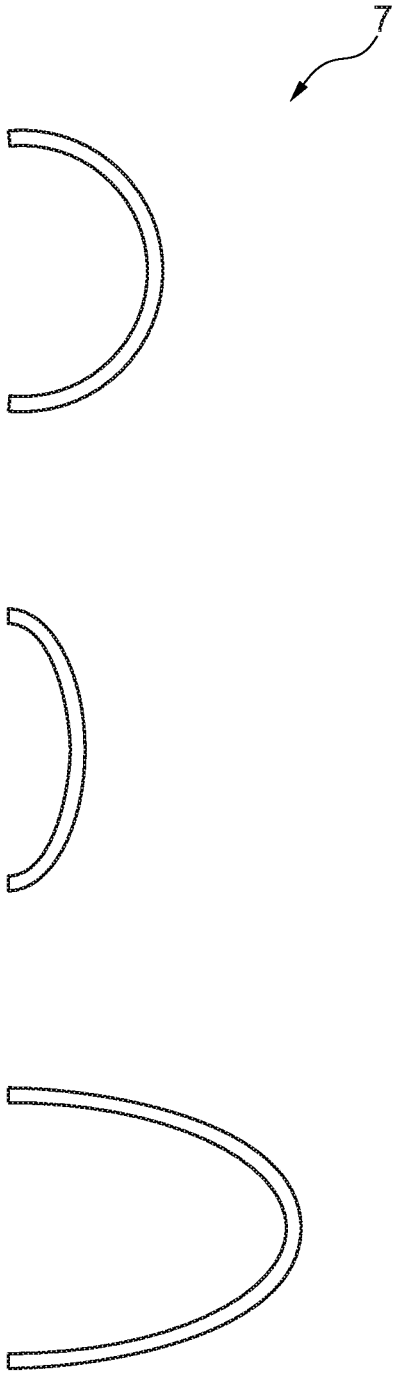
FIG. 3 illustrates different vibration dampening element.

FIG. 3 illustrates a cross-section of different vibration dampening elements 7. As illustrated the cross-section is ach-shaped. It should be understood, that the substantially flat vibration dampening element 107 illustrated in FIG. 2 could be substituted with any one of the vibration dampening elements 7 of FIG. 3.

Figure 4:
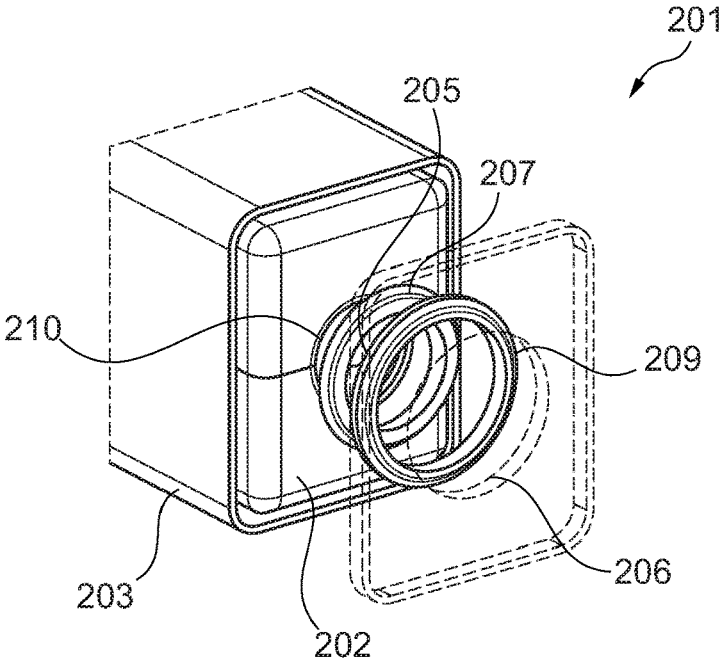
FIG. 4 illustrates a receiver assembly in an exploded view with details of a sound outlet.

FIG. 4 illustrates a receiver assembly 201 in an exploded view. The receiver assembly 201 comprises a receiver 202 and an assembly housing 203. The receiver 202 is arranged within the assembly housing 203 comprising an assembly sound outlet 206.

The receiver 202 comprises a sound outlet 205 configured to outlet sound from the receiver 202. The sound outlet 205 is arranged in communication with the assembly sound outlet 206.

A vibration dampening element 207 connects the sound outlet 205 and the assembly sound outlet 206 and is compliant to reduce vibrations from the receiver 202 to the assembly housing 203.

In the illustrated embodiment, the receiver assembly 201 further comprises two stiffening members 209, 210. The stiffening members 209, 210 are more rigid than the vibration dampening element 207. By providing the stiffening members 209, 210 with a compliance being lower than the compliance of the vibration dampening element 207, connection of the vibration dampening element to the receiver 202 and to the assembly housing 203 may be facilitated.

Figure 5:
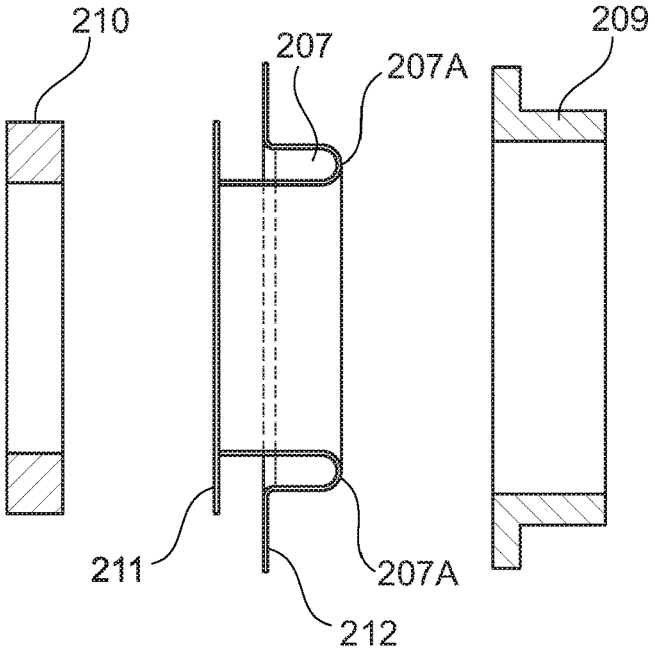
FIG. 5 illustrates a vibration dampening element and two stiffening members.

FIG. 5 illustrates the vibration dampening element 207 and the two stiffening members 209, 210 in more details. The vibration dampening element 207 can be attached to the stiffening members 209, 210, respectively at the attachment surfaces 211, 212. It should be understood, that the attachment surfaces 211, 212 are also applicable for attached directly to the receiver 201 and the assembly housing 203, respectively, if the stiffening member 209, 210 are not used. Thus, it should be understood, that the stiffening members 209 and 210 are not required to ensure decoupling or ensure propagation of sound. They may facilitate assembling of the receiver assembly.

As illustrated in FIG. 5, the vibration dampening element 207 forms a first attachment plane 211 in which it can be attached to the receiver 201 and a second attachment plane 212 in which it can be attached to the assembly housing 203. The first and second attachment planes 211, 212 are parallel and off-set relative to each other, so that the vibration dampening element 207 extends in a direction transverse to the first and second attachment planes 211, 212.

The vibration dampening element 207 has an arc-shaped cross-section 207A (see more details in FIG. 7) in a plane perpendicular to the attachment planes 211, 212.

Figure 6:
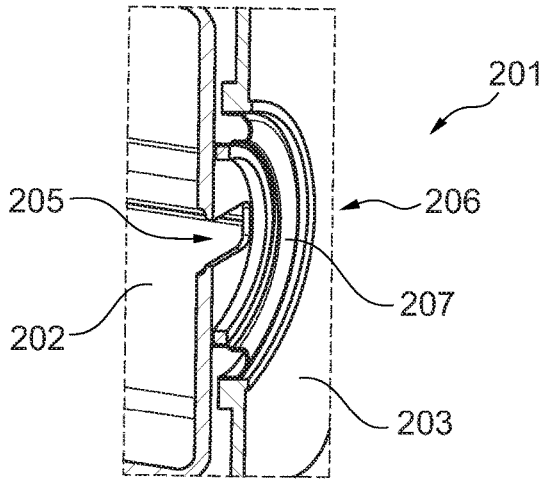
FIG. 6 illustrates a cross-section of a receiver assembly with details of a sound outlet.

FIG. 6 illustrates a cross-section through the receiver assembly 201 of FIG. 4. As mentioned above, the receiver assembly 201 comprises a receiver 202 and an assembly housing 203.

The receiver 202 comprises a sound outlet 205 configured to outlet sound from the receiver 202. The sound outlet 205 is arranged in communication with the assembly sound outlet 206. Furthermore, a vibration dampening element 207 connects the sound outlet 205 and the assembly sound outlet 206.

Figure 7:
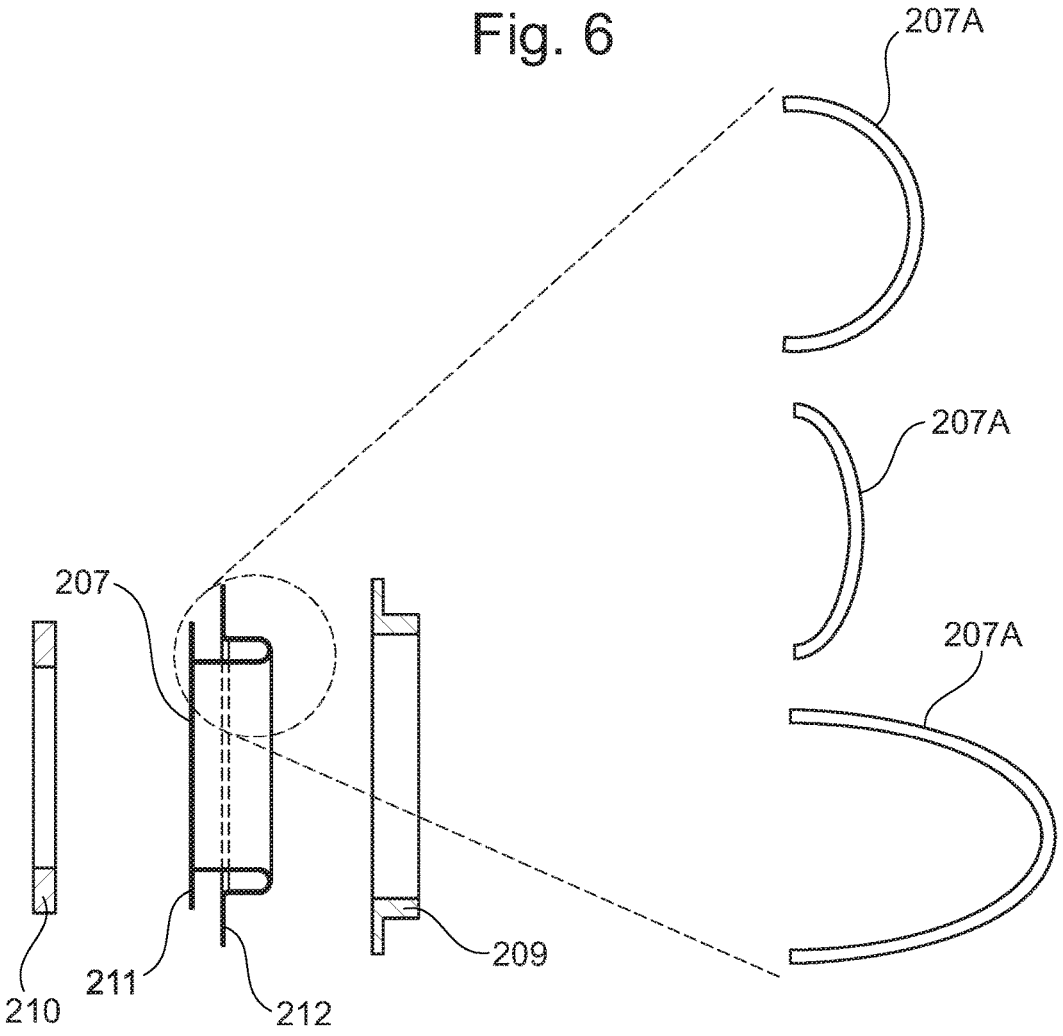
FIG. 7 illustrates details of a vibration dampening element.

FIG. 7 illustrates the vibration dampening element 207 and the stiffening members 209, 210, also illustrated in FIG. 5. FIG. 7 illustrates details of a vibration dampening element 207. The vibration dampening element 207 forms a first attachment plane 211 in which it can be attached to the receiver 201 or the stiffening member 210 and a second attachment plane 212 in which it can be attached to the assembly housing 203 or the stiffening member 209. The first and second attachment planes 211, 212 are parallel and off-set relative to each other. The vibration dampening element 207 has an arc-shaped cross-section 207A in a plane being perpendicular to the attachment planes 211, 212. The right side part of FIG. 7, illustrates three different arc-shaped sections 7A of the vibration dampening element 7.

Figure 8A:
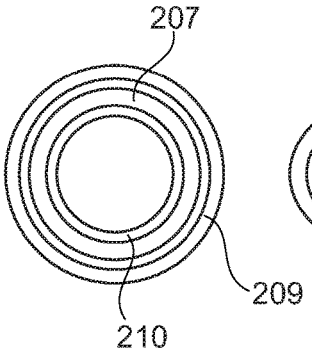
FIGS. 8A-8C illustrate different embodiments of a vibration dampening element.
Figure 8B:
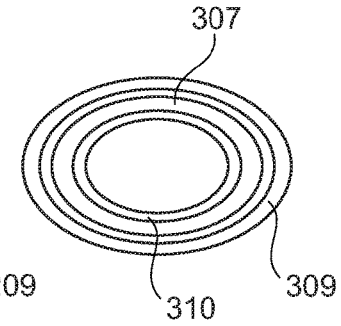
Figure 8C:
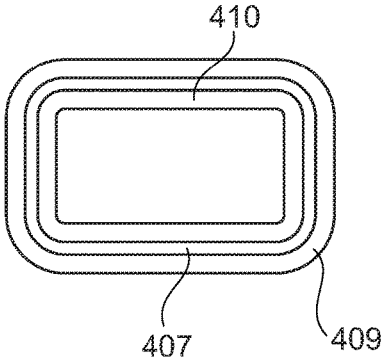

FIGS. 8A-8C illustrate different embodiments of a vibration dampening element 207, 307. 407. The vibration dampening elements are similar except for their shape which is circular, oval, and rectangular. FIGS. 8A-8C also illustrate corresponding stiffening elements 209, 210, 309, 310, 409, 410.

Figure 9A:
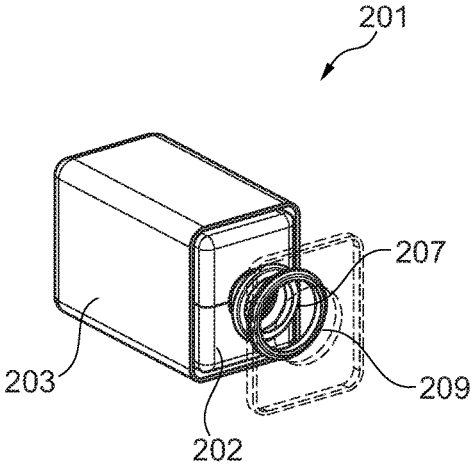
FIGS. 9A and 9B illustrate different embodiments of a receiver assembly in an exploded view.
Figure 9B:
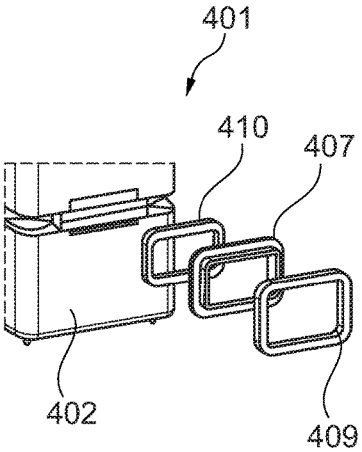

FIGS. 9A and 9B illustrate different embodiments of a receiver assembly 201, 401 in exploded views. The receiver assembly 201, 401 comprises a receiver 202, 402 and an assembly housing 203, 403.

A vibration dampening element 207, 401 connects the sound outlet 205, 405 and the assembly sound outlet 206, 406. Furthermore, the receiver assembly 201, 401 comprises stiffening members 209, 210, 409, 410.

Figure 10:
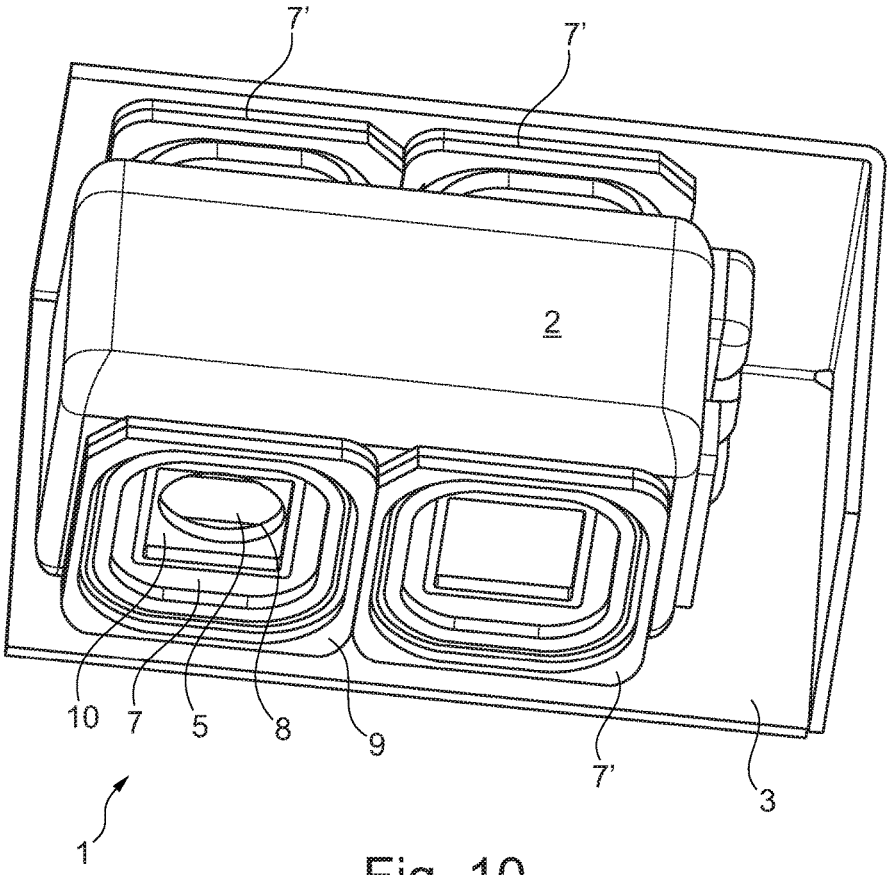
FIG. 10 illustrates an alternative embodiment of a receiver assembly.

FIG. 10 illustrates an embodiment of a receiver assembly 1 in 3D. The receiver assembly 1 comprises a receiver 2 and an assembly housing 3 (only being partly visible). The receiver 2 is arranged within the assembly housing 3 which comprising an assembly sound outlet (not shown).

The receiver 2 comprises a sound outlet 5 configured to outlet sound from the receiver 2. The sound outlet 5 is arranged in communication with the assembly sound outlet 6.

A vibration dampening element 7 connects the sound outlet 5 and the assembly sound outlet 6 and is compliant to reduce vibrations from the receiver 2 to the assembly housing 3.

The vibration dampening element 7 comprises a through hole 8 allowing sound to propagate through the vibration dampening element. Furthermore, the receiver assembly 1 comprises stiffening members 9, 10 to which the vibration dampening element 7 is attached.

Additionally, three suspension elements 7' are arranged in the assembly housing 3. The suspension elements 7' connect the receiver 2 and the assembly housing 3. The suspension elements 7' are similar to the vibration dampening element 7, however without a through hole. Due to the compliance of the suspension element 7', the receiver 2 is movable arranged in the assembly housing 3.

Figure 11A:
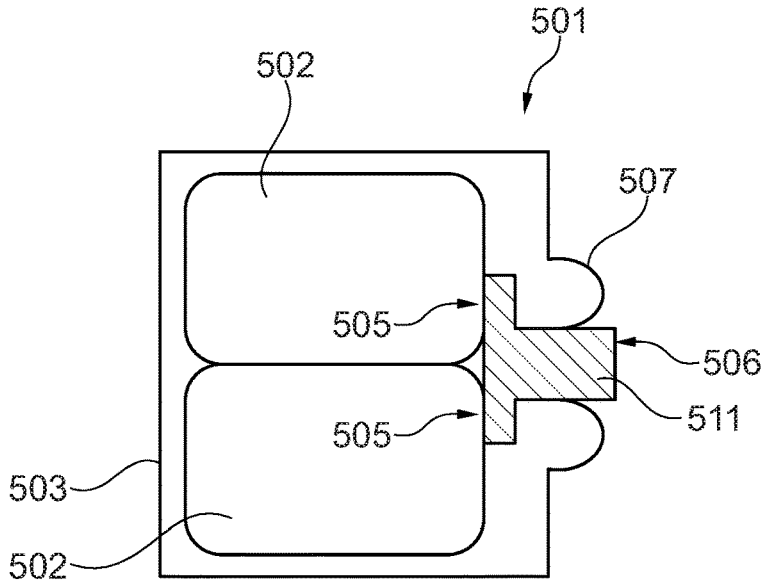
FIGS. 11A and 11B illustrate different embodiments of a receiver assembly comprising two receivers.
Figure 11B:
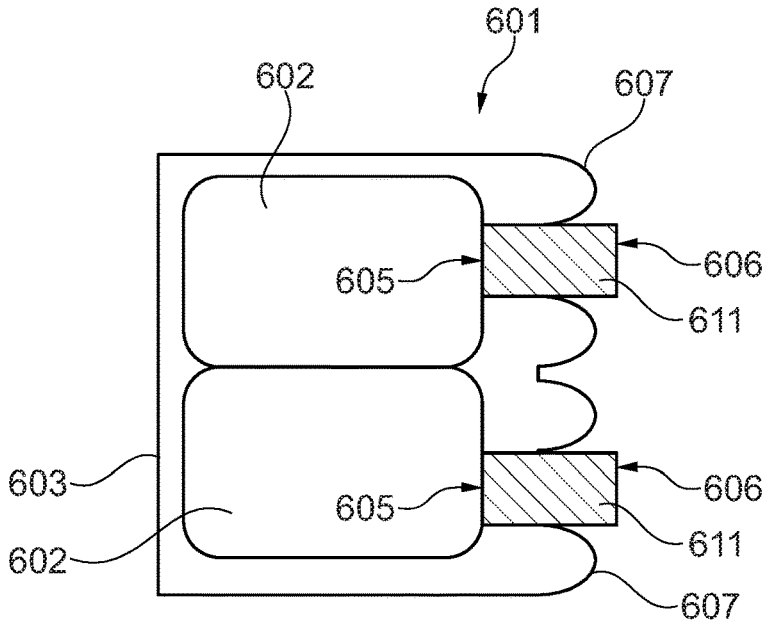

FIGS. 11A and 11B illustrate different embodiments of a receiver assembly 501, 601 each comprising two receivers 502, 602. The receivers 502, 602 are arranged within the assembly housing 503, 603 which comprising an assembly sound outlet 506, 606. In the illustrated embodiments, the receivers 502 are identical, and also the receivers 602 are identical.

The receivers 502, 602 each comprises a sound outlet 505, 605 configured to outlet sound from the receivers 502, 602. The sound outlets 505, 605 are arranged in communication with the assembly sound outlet(s) 506, 606 via a spout part 511, 611.

A vibration dampening element 507, 607 connects the sound outlets 505, 605 and the assembly sound outlet(s) 506, 606 via the spout part 511, 611. The vibration dampening element 507, 607 is compliant to reduce vibrations from the receivers 502, 602 to the assembly housing 503, 603.

In the embodiment illustrated in FIG. 11A, the spout part 511 is a common spout part which connects the sound outlet 505 from each of the receivers 502 to the assembly sound outlet 506.

The embodiment illustrated in FIG. 11B, comprises two separate spout parts 611 each connecting a sound outlet 605 of the receivers 602 to an assembly sound outlet 606.

Figure 12A:
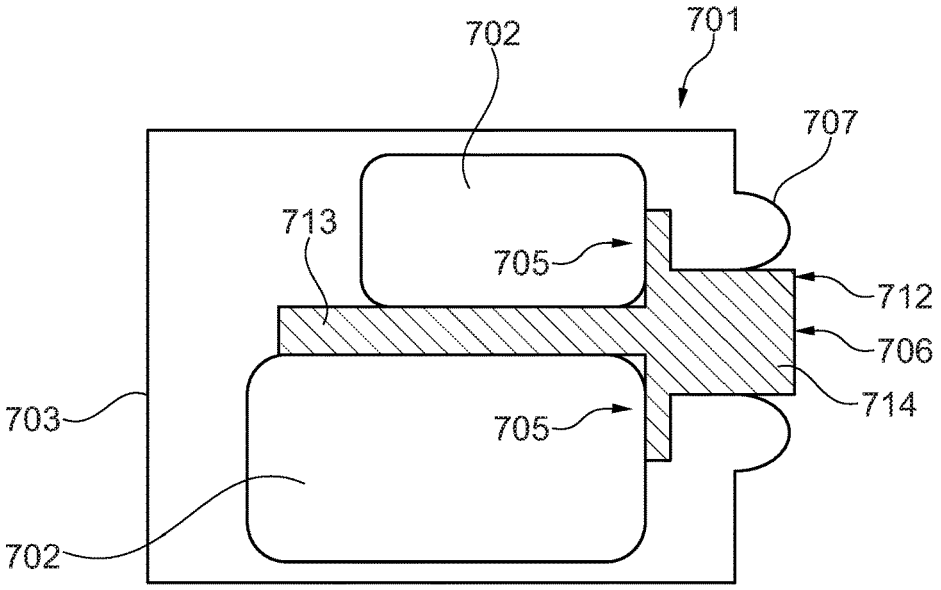
FIGS. 12A and 12B illustrate different embodiments of a receiver assembly comprising two receivers.
Figure 12B:
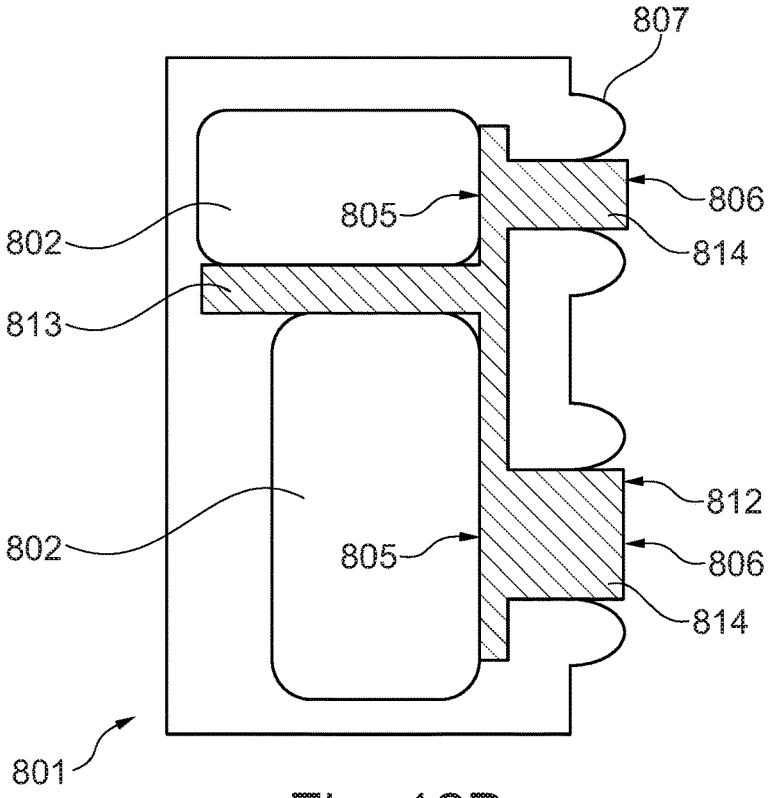

FIGS. 12A and 12B illustrate different embodiments of a receiver assembly 701, 801 each comprising two receivers 702, 802. The receivers 702, 802 are arranged within the assembly housing 703, 803 which comprising an assembly sound outlet 706, 806. In the illustrated embodiments, the receivers 702 are of different types. Also the receivers 802 are of different types.

The receivers 702, 802 each comprises a sound outlet 705, 805 configured to outlet sound from the receivers 702, 802. The sound outlets 705, 805 are arranged in communication with the assembly sound outlet(s) 706, 806 via a joiner 712, 812.

A vibration dampening element 707, 807 connects the sound outlets 705, 805 and the assembly sound outlet(s) 706, 806 via the joiner 712, 812. The vibration dampening element 707, 807 is compliant to reduce vibrations from the receivers 702, 802 to the assembly housing 703, 803.

The joiner 712, 812 comprises a mounting plate portion 713, 813 having a first surface and an opposite second surface. The mounting plate portion 713, 813 comprises first engagement means (not shown) for engaging the upper receiver 702 at the first surface, and second engagement means (not shown) for engaging the lower receiver 702 at the second surface.

Furthermore, the joiner 712, 812 comprise a spout portion 714, 814 forming at least one sound channel (not shown) extending through the spout portion. When arranging the receivers 702, 802 on opposite sides of the mounting plate portion 713, 813, the sound outlets 705, 805 can be arranged in communication with one of the at least one sound channels extending through the spout portion 714, 814.

In the embodiment illustrated in FIG. 12A, the joiner 812 comprises a common spout portion 714 which connects the sound outlet 705 from each of the receivers 702 to the assembly sound outlet 706.

The embodiment illustrated in FIG. 12B, comprises a joiner 812 with two separate spout portions 814 each connecting a sound outlet 805 of the receivers 802 to an assembly sound outlet 806.

The invention claimed is:

1. A receiver assembly comprising a receiver and an assembly housing;

the receiver comprising a sound outlet configured to outlet sound from the receiver and being arranged at least partly within the assembly housing, the assembly housing comprising an assembly sound outlet, wherein the sound outlet is arranged in communication with the assembly sound outlet for outlet of sound from the receiver via the assembly sound outlet, and wherein a vibration dampening element connects the sound outlet and the assembly sound outlet, the vibration dampening element being formed by an elastic foil and being compliant to reduce vibrations from the receiver to the assembly housing.

2. A receiver assembly according to claim 1, wherein the receiver is movably arranged in the assembly housing.

3. A receiver assembly according to claim 1, wherein the vibration dampening element seals a passage between an outer surface of one of the sound outlet and the assembly sound outlet and an inner surface of the other one of the sound outlet and the assembly sound outlet.

4. A receiver assembly according to claim 1, wherein the vibration dampening element forms a sound channel from the sound outlet to the assembly sound outlet.

5. A receiver assembly according to claim 1, wherein the vibration dampening element forms a first attachment plane in which it is attached to the receiver and forms a second attachment plane in which it is attached to the assembly housing, and wherein the first and second attachment planes are off-set relative to each other.

6. A receiver assembly according to claim 5, wherein the first and second attachment planes are parallel.

7. A receiver assembly according to claim 5, wherein the vibration dampening element has an arc-shaped cross-section in a plane being perpendicular to the attachment planes.

8. A receiver assembly according to claim 1, wherein the receiver comprises an additional sound outlet, and wherein the assembly housing comprises an additional assembly sound outlet, the additional sound outlet being arranged in communication with the additional assembly sound outlet for outlet of sound from the receiver via the additional assembly sound outlet, and wherein an additional vibration dampening element connects the additional sound outlet and the additional assembly sound outlet and is compliant to reduce vibrations from the receiver to the assembly housing.

9. A receiver assembly according to claim 1, further comprising at least one stiffening member being more rigid than the vibration dampening element and connecting the vibration dampening element to at least one of the receiver and the assembly housing.

10. A receiver assembly according to claim 1, further comprising an air path way configured to guide air away from the receiver to reduce pressure induced vibrations.

11. A receiver assembly according to claim 1, wherein the vibration dampening element is welded to at least one of the receiver and the assembly housing.

12. A receiver assembly according to claim 1, wherein the vibration dampening element is formed by a polymer material or by a metal, or combinations hereof.

13. A receiver assembly according to claim 1, further comprising a shock protection element arranged in the assembly housing, the shock protection element having a higher compliance than the vibration dampening element.

14. A receiver assembly according to claim 1, further comprising:

an additional receiver comprising an additional sound outlet; and a joiner comprising a spout portion forming at least one sound channel extending through the spout portion and a mounting plate portion having a first surface and an opposite second surface; the mounting plate portion comprising first engagement means for engaging the receiver at the first surface, and second engagement means for engaging the additional receiver at the second surface, wherein the sound outlet and the additional sound outlet are aligned with one of the at least one sound channels, and wherein the vibration dampening element connects the sound outlet and the additional sound outlet to the assembly sound outlet via the spout portion.

15. A personal audio device comprising a receiver assembly according to claim 1, wherein the receiver is configured to generate sound whereby it vibrates within a frequency range of 10 Hz-20 kHz, and wherein the vibration dampening elements is configured to elastically deform to thereby reduce transmission of vibration to the assembly housing.

16. A receiver assembly according to claim 2, wherein the vibration dampening element seals a passage between an outer surface of one of the sound outlet and the assembly sound outlet and an inner surface of the other one of the sound outlet and the assembly sound outlet.

17. A receiver assembly according to claim 2, wherein the vibration dampening element forms a sound channel from the sound outlet to the assembly sound outlet.

18. A receiver assembly according to claim 2, wherein the vibration dampening element forms a first attachment plane in which it is attached to the receiver and forms a second attachment plane in which it is attached to the assembly housing, and wherein the first and second attachment planes are off-set relative to each other.

19. A receiver assembly according to claim 2, further comprising at least one stiffening member being more rigid than the vibration dampening element and connecting the vibration dampening element to at least one of the receiver and the assembly housing.

20. A receiver assembly according to claim 3, further comprising:

an additional receiver comprising an additional sound outlet; and a joiner comprising a spout portion forming at least one sound channel extending through the spout portion and a mounting plate portion having a first surface and an opposite second surface; the mounting plate portion comprising first engagement means for engaging the receiver at the first surface, and second engagement means for engaging the additional receiver at the second surface, wherein the sound outlet and the additional sound outlet are aligned with one of the at least one sound channels, and wherein the vibration dampening element connects the sound outlet and the additional sound outlet to the assembly sound outlet via the spout portion.

* * * * *